US007257349B2

(12) United States Patent
Kitozaki

(10) Patent No.: US 7,257,349 B2
(45) Date of Patent: Aug. 14, 2007

(54) IMAGE FORMING APPARATUS WHOSE IMAGE BEARING MEMBER AND DEVELOPING DEVICE ARE PROVIDED IN A CARTRIDGE DISMOUNTABLY MOUNTED TO THE APPARATUS

(75) Inventor: Yukihiro Kitozaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/141,012

(22) Filed: Jun. 1, 2005

(65) Prior Publication Data

US 2005/0281581 A1 Dec. 22, 2005

(30) Foreign Application Priority Data

Jun. 16, 2004 (JP) ..... 2004-178621

(51) Int. Cl.
*G03G 21/16* (2006.01)

(52) U.S. Cl. ..... 399/111; 399/258; 399/110

(58) Field of Classification Search ..... 399/111, 399/110, 112, 113, 258, 262, 399, 107
See application file for complete search history.

(56) References Cited

U.S. PATENT DOCUMENTS 5,345,295 A 9/1994 Takano et al. ..... 355/200
5,398,098 A * 3/1995 Fukunaga et al. ..... 399/110
6,009,289 A * 12/1999 Sekine et al. ..... 399/113
6,219,504 B1 * 4/2001 Matsuzaki et al. ..... 399/92
6,418,294 B2 * 7/2002 Morikami et al. ..... 399/298
6,708,011 B2 * 3/2004 Nomura et al. ..... 399/110
6,728,500 B2 * 4/2004 Naito et al. ..... 399/113
6,819,897 B2 * 11/2004 Kita ..... 399/223
6,823,158 B2 * 11/2004 Yamada et al. ..... 399/179
6,907,206 B2 * 6/2005 Hattori et al. ..... 399/90
6,980,766 B2 * 12/2005 Ito ..... 399/395
2005/0281591 A1 12/2005 Kitozaki et al. ..... 399/258

FOREIGN PATENT DOCUMENTS

JP 06-110337 A 4/1994
JP 2003-202792 A 7/2003

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

The image forming apparatus includes an image bearing member for forming an electrostatic image, a developing apparatus for developing the electrostatic image on the image bearing member with a developer, a developer container for containing a replenishing developer, and dismountably mounted on a main body of the apparatus, and a developer replenishing apparatus for replenishing the replenishing developer in the developer container to the developing apparatus, wherein at least the image bearing member and the developing apparatus are provided in a cartridge which is dismountably mountable on the main body of the apparatus and the developer container is provided in a position not overlapping with a moving area of the cartridge in a dismounting or mounting operation of the cartridge.

6 Claims, 14 Drawing Sheets

IMAGE FORMING APPARATUS WHOSE IMAGE BEARING MEMBER AND DEVELOPING DEVICE ARE PROVIDED IN A CARTRIDGE DISMOUNTABLY MOUNTED TO THE APPARATUS

BACKGROUND OF THE INVENTION

1. Field of the Invention

The present invention relates to an image forming apparatus such as a copying apparatus or a printer, for forming an image on a recording material utilizing an electrophotographic process.

2. Related Background Art

Current electrophotographic image forming apparatuses widely employ a dismountably mounted process cartridge integrating a photosensitive drum, a developing device and the like thereby facilitating maintenance or toner replenishment. Such a process cartridge is required to contain a toner of an amount corresponding to a service life of the photosensitive drum defined by a deterioration thereof, and therefore tends to become bulky.

Since the consumed toner amount varies significantly depending on the density of images formed by the user, the cartridge has to be replaced when the deterioration of the photosensitive drum or the consumption of the toner reaches a certain amount, and such cartridge replacement at a somewhat early stage when the photosensitive drum or the toner has a certain remaining capacity tends to increase the running cost.

For this reason, there has recently been commercialized an image forming apparatus in which a process cartridge and a toner cartridge for supplying a toner to a developing device in the process cartridge are constructed separately and rendered respectively mountable.

For example, as shown in FIGS. 12A and 12B, four process cartridges 200 for respectively forming yellow, magenta, cyan and black color images, and four toner cartridges 202 for respectively toner supply to the process cartridges 200 are mounted on a main body 201 of an apparatus, and toner images formed on photosensitive drums 200*a* in the process cartridges 200 are primary transferred in succession onto an intermediate transfer belt 203, and the primary transfer images are secondary transferred in a secondary transfer part 206 onto a transfer material conveyed from a sheet cassette 204 by conveying rollers 205. Then, such transfer material is conveyed to a fixing device 207 for heat fixation of the toner images and is discharged onto a discharge portion 208 in an upper part of the apparatus.

Such separation of the toner cartridge from the process cartridge enables a replacement of each cartridge according to the consumption in the running operation of each cartridge, thereby reducing the running cost.

Patent literature 1: Japanese Patent Application Laid-Open No. H06-110337;

Patent literature 2: Japanese Patent Application Laid-Open No. 2003-202792.

However, in a prior image forming apparatus in which the process cartridges 200 and the toner cartridges 201 are individually mounted, the process cartridges 200 are positioned inside a frame member 209 of a main body 202. On the other hand, the toner cartridges 201 are positioned in an overlapping manner with the process cartridges 200, in a Z-axis direction which is a direction of a rotary axis of photosensitive drums 200*a* incorporated in the process cartridges 200. Further, as the toner cartridges 201 are positioned above the process cartridges 200 for toner supply thereto, the process cartridges 200 and the toner cartridges 201 mutually overlap also in a Y-axis direction.

Therefore, in case of a replacement of the toner cartridge 201, as shown in a lateral view in FIG. 13, cartridge replacement covers 210, 211 are opened and a toner cartridge 201 is taken out.

In case of a replacement of the process cartridge 200, the configuration requires operations of at first temporarily detaching a toner cartridge 201, then removing a process cartridge 200, then setting a new process cartridge 200, and setting the temporarily detached toner cartridge 201 on the set process cartridge 200.

Therefore, the user operability is poor in the replacement of the process cartridge. Also in case of the replacement of the process cartridge, as the toner cartridge is temporarily detached in a state containing remaining toner, the toner may drop from the toner cartridge 201 and may be scattered in the apparatus since the toner cartridge 201 is positioned in the frame member of the main body.

Furthermore, as exposure means 212 are positioned above the photosensitive drums 200*a*, the image transferred from the photosensitive drum 200*a* to the intermediate transfer belt 203 travels from P1 to P2 as shown in FIGS. 12A and 12B, so that the primary transferred image has to be conveyed over a long moving distance Q1 before the secondary transfer. Therefore the user has to wait a corresponding time for obtaining a printout, and there results a long first print time.

On the other hand, there can be conceived an image forming apparatus as shown in FIGS. 14A and 14B, in which exposure means 212 is positioned below the process cartridges 200 and the intermediate transfer belt 203 is positioned above the process cartridges. In such configuration, a moving distance Q2 of the image, transferred from the photosensitive drum 200*a* to the intermediate transfer belt 203, to the secondary transfer is shortened, thereby reducing the first printout time.

However, also in this configuration, the process cartridges 200 and the toner cartridges 201 are superposed in the direction of the rotary axis of the photosensitive drums 200*a* and in the direction of height of the apparatus, so that the toner cartridge 201 has to be removed at first in case of replacing the process cartridge 200. Also, as the exposure means 212 is positioned below the process cartridges 200 and the toner cartridges 201, a toner 213 spilt at the removal of the toner cartridge 201 may be deposited on the exposure means 212.

SUMMARY OF THE INVENTION

The present invention has been made in consideration of the current situation described above, and an object of the present invention is to provide an image forming apparatus in which a developer container and a cartridge are mounted separately and an operability in cartridge replacement is improved.

The above-mentioned object can be attained, according to the present invention, by an image forming apparatus including:

an image bearing member for forming an electrostatic image;

developing means which develops the electrostatic image on the image bearing member with a developer;

a developer container for containing a replenishing developer, the developer container being dismountably mountable on a main body of the apparatus; and developer replenishing means for replenishing the replenishing developer in the developer container to the developing means;

wherein at least the image bearing member and the developing means are provided in a cartridge which is dismountably mountable on a main body of the apparatus; and wherein the developer container is provided in a position not overlapping with a moving area of the cartridge in a dismounting or mounting operation of the cartridge.

DETAILED DESCRIPTION OF THE PREFERRED EMBODIMENTS

In the following an image forming apparatus constituting an embodiment of the present invention will be explained with reference to the accompanying drawings.

<Entire Configuration of Image Forming Apparatus>

At first the entire configuration of the image forming apparatus of the present embodiment will be explained with reference to FIG. 1. The image forming apparatus of the present embodiment is a multi-color or full-color electrophotographic image forming apparatus constructed as a so-called in-line type apparatus, in which plural photosensitive drums 1 corresponding to the respective colors are arranged in a row and toner images of respective colors formed on such photosensitive drums are superposed in succession onto an intermediate transfer belt thereby forming a color image.

Figure 1:
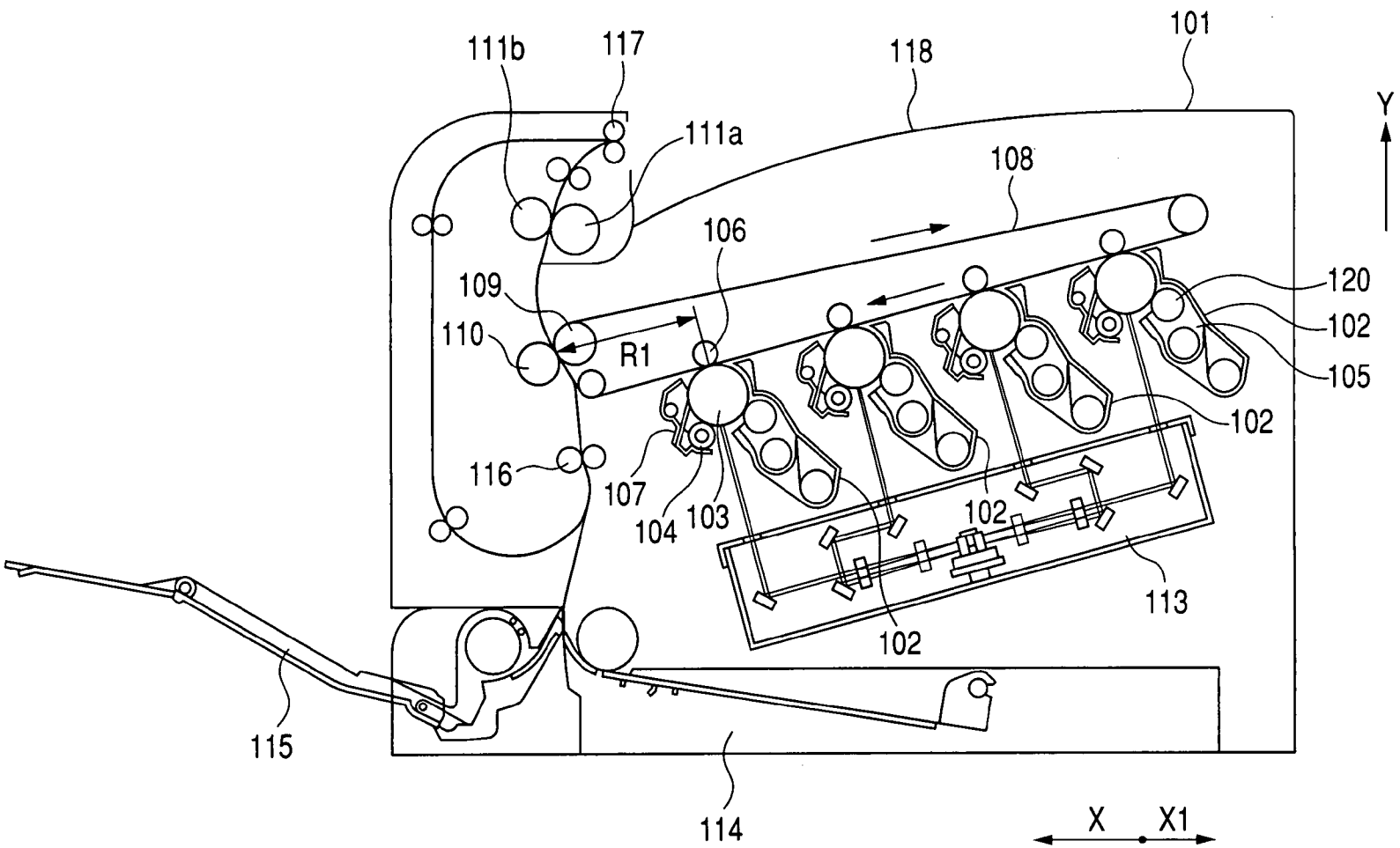
FIG. 1 is a schematic cross-sectional view of an image forming apparatus.

FIG. 1 is a schematic cross-sectional view of the image forming apparatus. The image forming apparatus 101 is provided with four process cartridges 102, which are positioned along a substantially horizontal line with a constant gap therebetween and which respectively form images of yellow, magenta, cyan and black colors.

Each process cartridge 102 is provided with a drum-shaped electrophotographic photosensitive member (hereinafter called hotosensitive drum 103 serving as an image bearing member. Around the photosensitive drum 103, there are provided a primary charger 104, developing means 105, a transfer roller 106 as transfer means and a drum cleaning apparatus 107, and a laser exposure apparatus 113 serving as exposure means is provided below a gap between the primary charger 104 and the developing means 105.

The photosensitive drum 103 is a negatively chargeable OPC photosensitive member having a photoconductive layer on an aluminum drum substrate, and is rotated at a predetermined process speed by a driving apparatus (not shown).

The primary charger 104 serving as primary charging means uniformly charges the surface of the photosensitive drum 103 at a predetermined negative potential by a charging bias supplied from a charging bias source (not shown).

The developing means 105 contains a toner and deposits the toner of a respective color onto an electrostatic latent image formed on each photosensitive drum 103, thereby developing a toner image (visible image).

The transfer roller 106 serving as primary transfer means is positioned inside an intermediate transfer belt unit 108 and is opposed and pressed to the photosensitive drum 103.

The drum cleaner apparatus 107 is provided with a cleaning blade for removing a transfer residual toner, remaining on the photosensitive drum 103 at the primary transfer, from the photosensitive drum 103.

In the present embodiment, the process cartridge 102 integrally incorporates the primary charger 103, the developing means 105 and the drum cleaning apparatus 107 and is dismountably mounted on the main body of the apparatus.

The intermediate transfer belt unit 108 is positioned above the process cartridges 102, and is provided with an intermediate transfer belt, which is a rotatable intermediate transfer member, a driving roller 109 serving also a secondary transfer opposed roller, and an unillustrated gear provided on a shaft of the driving roller. The intermediate transfer belt is driven in rotation by an unillustrated driving gear on the main body. The driving roller 109 is so positioned as to be opposed to the secondary transfer roller 110.

As the intermediate transfer belt receiving the primary transfer is positioned above the process cartridges 102, a moving distance R1 of an image transferred onto the intermediate transfer belt from the last photosensitive drum 103 in the plural process cartridges to the secondary transfer is shortened, thereby reducing the first printout time.

Also at a downstream side of the secondary transfer roller 110 in the conveying direction of the transfer material, a fixing apparatus including a fixing roller 111*a* and a pressing roller 111*b* is provided with a vertical path configuration.

The exposure apparatus 113 is constituted for example of laser light emission means which emits a light corresponding to a time-sequential electric digital pixel signal of given image information, a polygon mirror, a reflection mirror and the like, and gives an exposure to each photosensitive drum 103, thereby forming an electrostatic latent image for a respective color corresponding to the image information, on the surface of each photosensitive drum 103 charged by the primary charger 104.

The electrostatic latent images formed on the respective photosensitive drums 103 are developed with toners by the developing means 105 as visible images, which are primary transferred in succession onto the intermediate transfer belt 108 to form a color image. In synchronization with the image formation, a transfer material is conveyed from a sheet cassette 114 or a manual feed tray 115 to a secondary transfer part by conveying rollers 116, and the toner image on the intermediate transfer belt 108 is secondary transferred onto the transfer material by a bias application to the secondary transfer roller 110. Then the transfer material is subject to a heat fixation in the fixing apparatus 111*a*, 111*b* and is discharged by discharge rollers 117 onto a discharge part 118 in an upper part of the apparatus.

As will be explained later, in the developing means 105 of each process cartridge 102, the toner is replenished from a toner cartridge separated from the process cartridge 102.

<Positioning of Process Cartridge and Toner Cartridge>

Figure 2B:
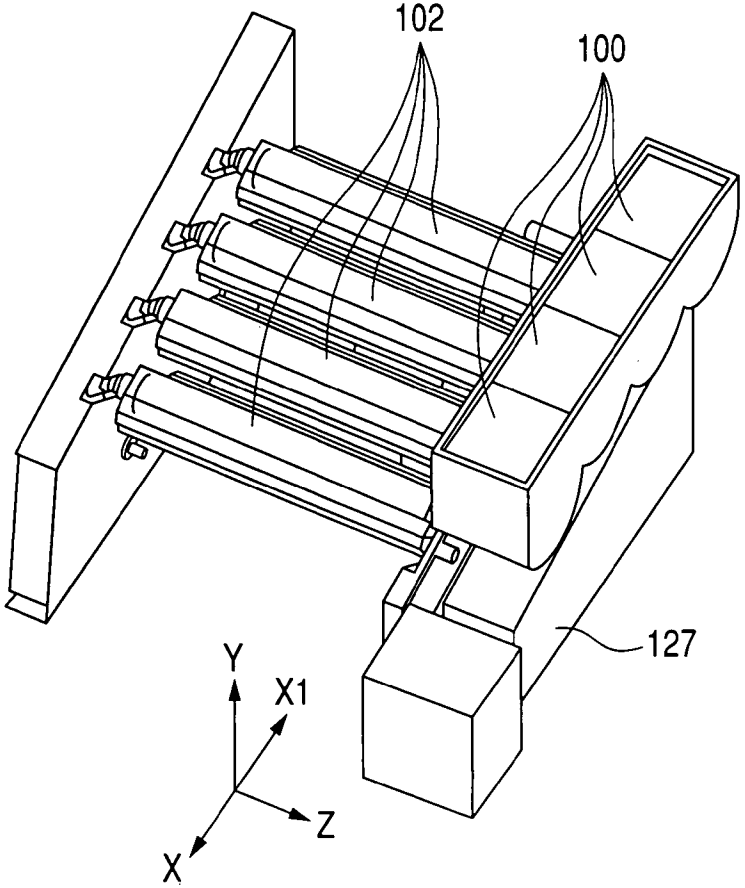
FIGS. 2A and 2B are schematic front perspective views of the image forming apparatus.
Figure 2A:
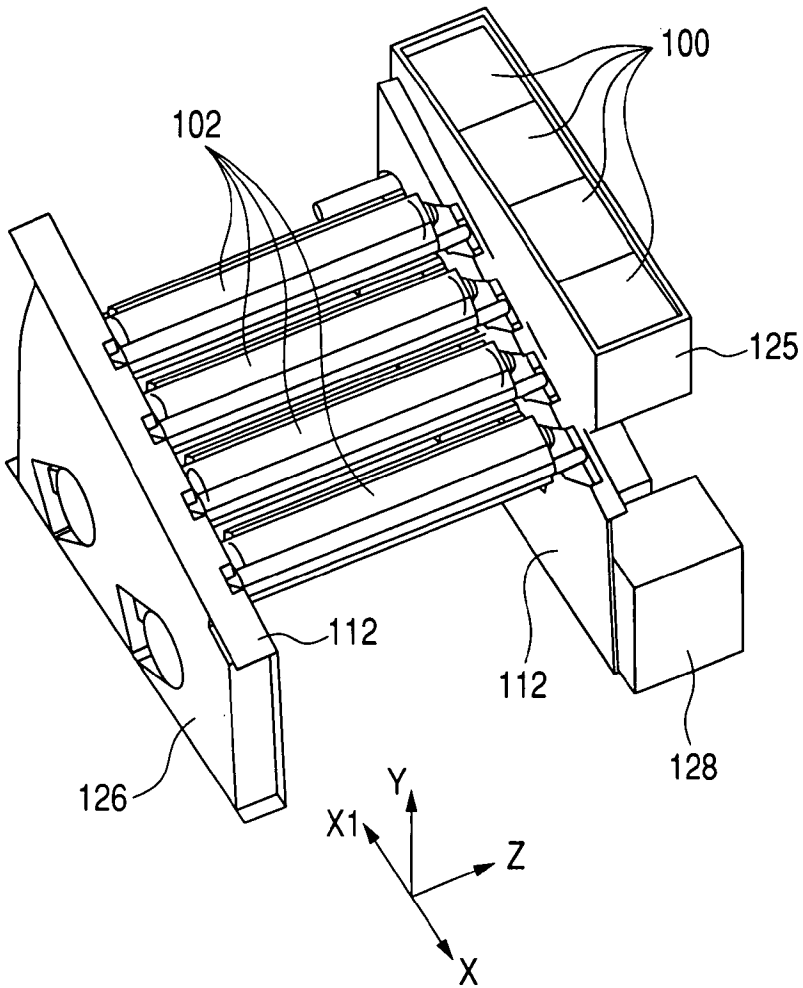
Figure 3:
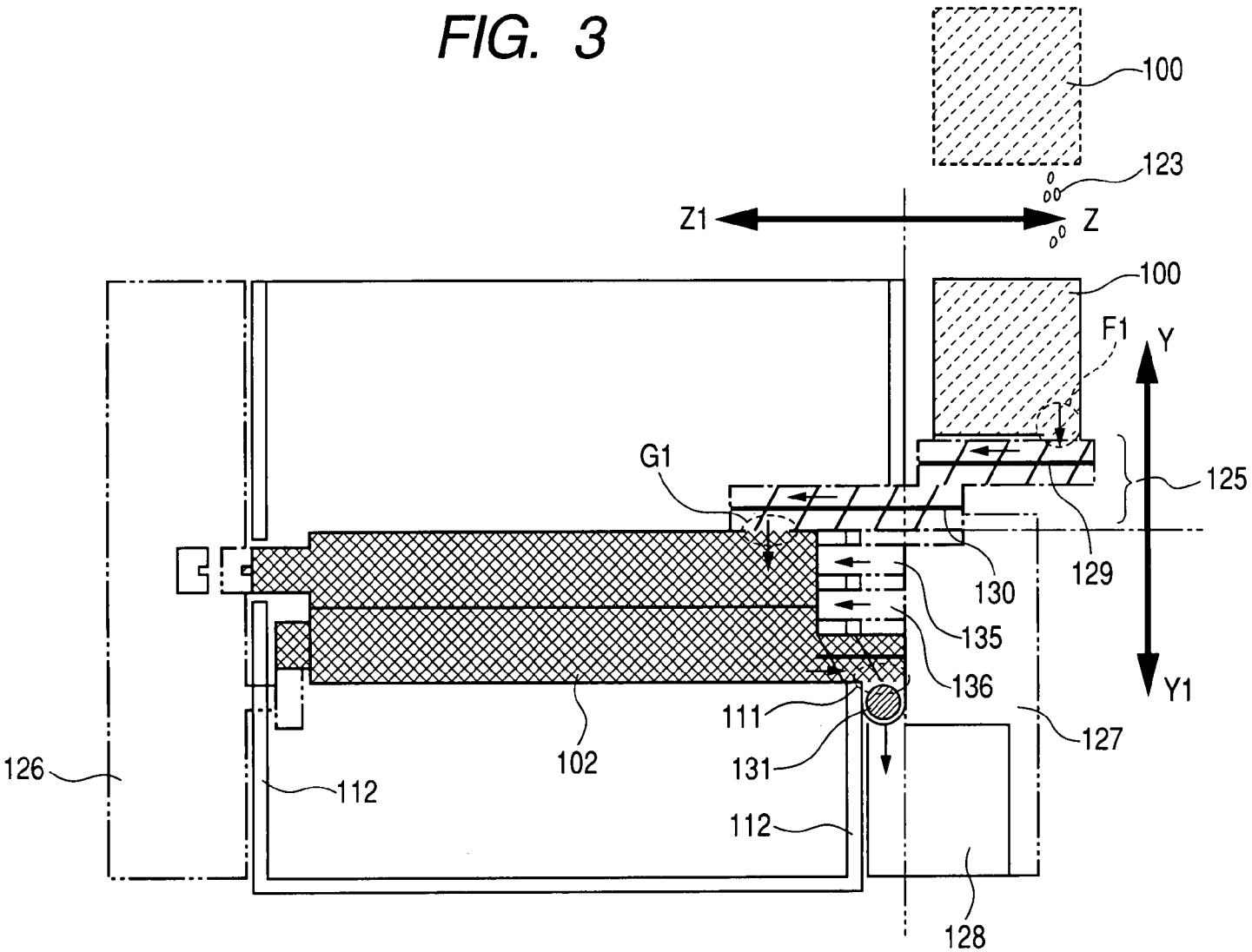
FIG. 3 is a view showing a position of the image forming apparatus seen from a front side thereof (in a direction X1 in FIGS. 2A and 2B)
Figure 4A:
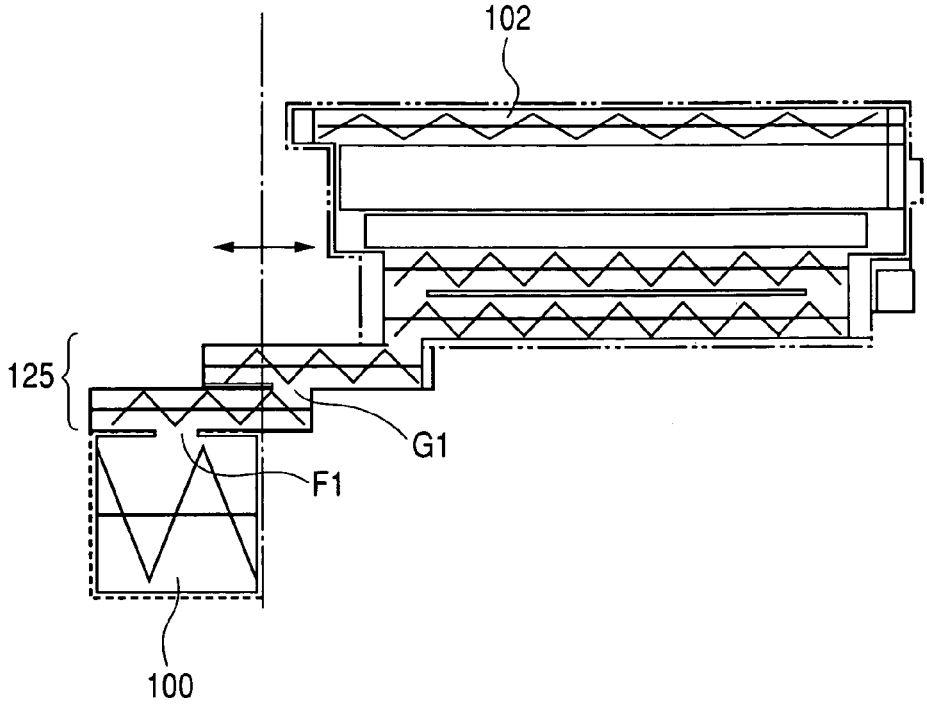
FIGS. 4A and 4B are schematic cross-sectional views of the image forming apparatus seen from above (in a direction Y1 in FIG. 3)
Figure 4B:
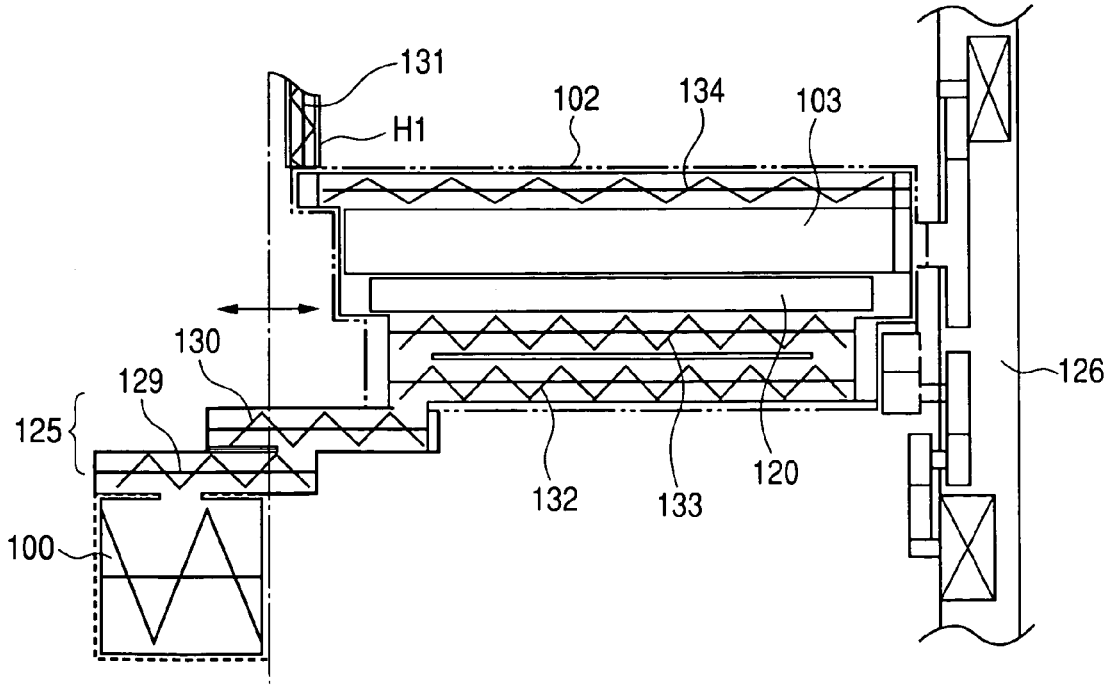

In the following, there will be explained, with reference to FIGS. 2A, 2B to 7, a positional configuration of the process cartridge 102 and the toner cartridge 100 and a toner circulation, featuring the present invention. FIGS. 2A and 2B are schematic frontal perspective view of the image forming apparatus, wherein an arrow X-X1 indicates a front-rear direction of the apparatus; an arrow Y indicates a direction of the height of the apparatus; and an arrow Z indicates a lateral direction of the apparatus. Also FIG. 3 is a schematic view showing an arrangement of the image forming apparatus seen from front (in a direction X1 in FIGS. 2A and 2B), and FIGS. 4A and 4B are schematic cross-sectional views of the image forming apparatus seen from above (in a direction Y1 in FIG. 3), wherein FIG. 2A shows a state without a drive of the main body and FIG. 2B shows a state with a drive of the main body.

As shown in FIGS. 2A and 2B, each process cartridge 102 of the present embodiment is supported and dismountably mounted in a main body frame member 112. Also a toner cartridge 100, for toner supply to the developing means 105 in each process cartridge 102 is provided separately from the process cartridge 102 and mounted in a mounting part of toner replenishment carrying means 125 provided outside the main body frame member 112.

Thus the process cartridge 102 and the toner cartridge 100 in the mounted state are so positioned as not to overlap in the direction of a rotary axis of the photosensitive drum 103, and the toner cartridge 100 is mounted higher than the process cartridge 102 in the main body of the apparatus.

A driving apparatus (drive means) 126 is provided for activating the process cartridges 102, and a high voltage source apparatus 127 for supplying a high voltage at the time of image formation is provided at a side opposed to the driving apparatus 126 in the Z-direction of the main body frame member 112 and under the toner replenishment carrying means 125. Also a toner recovery box 128 for collecting used toner discharged from the process cartridges 102 is replaceably provided in a frontal part (in X-direction) of the main body of the apparatus.

Such a configuration allows the apparatus to position drum gears or the like for receiving driving power from the driving apparatus 126 at a side in the longitudinal direction of the process cartridges 102, and to provide the other side with electrical contacts for receiving a developing bias, a charging voltage and the like to be connected with the high voltage source 127.

As shown in FIG. 3, a toner replenished in a part F1 of the toner cartridge 100 is carried by a first carrying screw 129 and a second carrying screw 130 of the toner replenishing carrying means 125 and is supplied at a constant rate into the process cartridge 102 positioned thereunder. Then, as shown in FIGS. 4A and 4B, the toner is agitated by a first agitating screw 132 and a second agitating screw 133 in the process cartridge 102 and coated by a developing screw thereby being deposited onto the photosensitive drum 103.

A transfer residual toner (hereinafter represented as sed toner, which is not primary transferred but remains on the photosensitive drum 103, is recovered by the drum cleaner apparatus 107 (cf. FIG. 1), carried by used toner carrying means 134 and discharged in a portion H1 from the process cartridge 102. Thus, discharged used toner is advanced to a used toner carrying apparatus 131 or toner discharge carrying means which carries the used toner by rotating a carrying screw, and is thus fed to the used toner recovery box 128 shown in FIG. 3.

Figure 5:
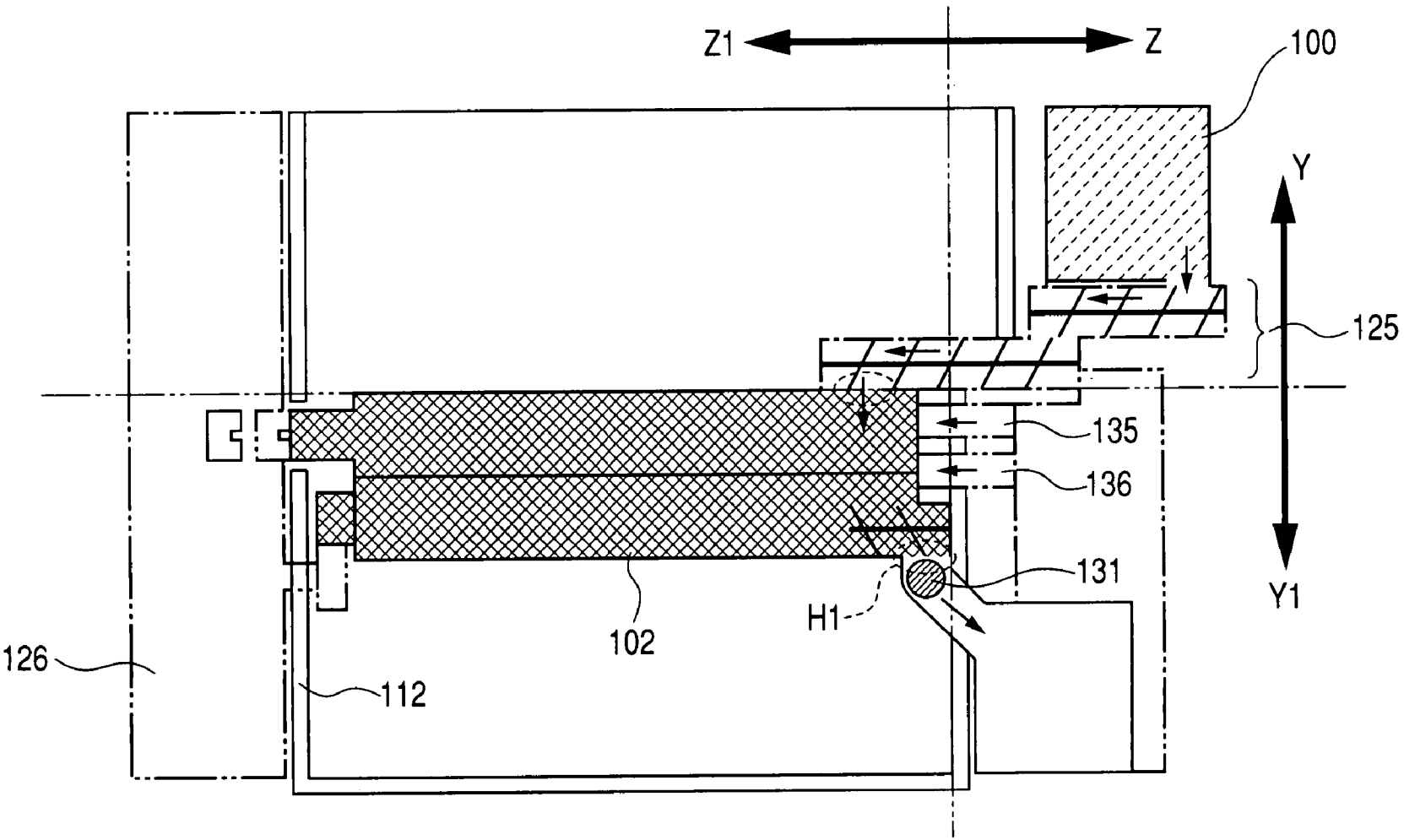
FIG. 5 is a schematic view showing a toner conveying state in the image forming apparatus seen from a front side.

In the configuration shown in FIG. 3, the used toner carrying apparatus 131 is positioned outside the main body frame member 112, but toner circulation can be executed in a similar manner also in a configuration in which the used toner carrying apparatus 131 is positioned inside the main body frame member 112 as shown in FIG. 5. In this manner the driving apparatus 126 and the toner circulating path can be provided in mutually opposed positions in the main body frame member 112 and there can be prevented a deterioration in drive transmitting precision, for example, of the driving gear resulting from toner scattering.

Figure 6:
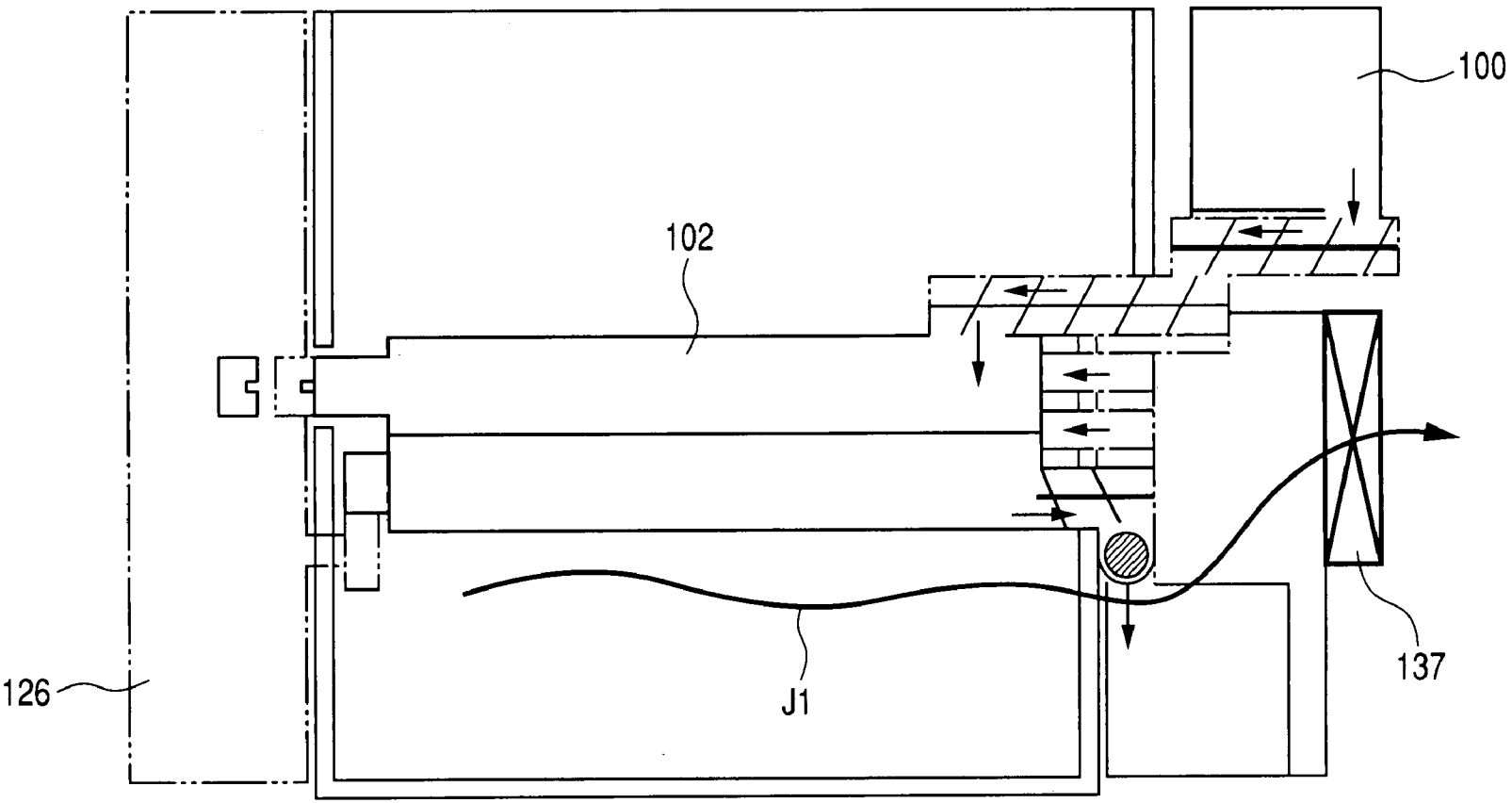
FIG. 6 is a schematic view showing an air path in the image forming apparatus seen from a front side.

Also, as shown in FIG. 6, an air flow J1, generated by a cooling fan 137 for preventing a temperature increase in the main body frame member 112 of the image forming apparatus, is so designed as to flow from the side of the driving apparatus 126 to the side of the toner circulating path, thereby enhancing the preventive effect for the deterioration in the drive transmitting precision, for example, of the driving gear resulting from the toner scattering.

<Positioning of Used Toner Carrying Apparatus and High Voltage Input>

In the following, an arrangement of the used toner carrying apparatus and a high voltage input to the process cartridge will be explained with reference to FIG. 7, which is a schematic view of the main body seen from a lateral direction (direction Z1 in FIG. 5).

The used toner carrying means 134 (cf. FIGS. 4A and 4B) bridges the process cartridges 102 in the front-rear direction of the apparatus (direction X-X1 in FIG. 7) and is positioned under the toner cartridges 100. It receives the used toner at the portions H1 of the process cartridges 102 and the used toner in the used toner carrying apparatus 131 is stored in the used toner recovery box 128.

High voltages such as a developing bias and a charging current for the process cartridge 102 are directly supplied thereto from the high voltage source 127 shown in FIG. 3 through a developing bias input contact 135 and a charging current input contact 136 of the process cartridge 102, thereby dispensing with a cable from the high voltage source and achieving a cost reduction and leak prevention.

In the image forming apparatus of the present embodiment, a mounting portion for mounting the plural process cartridges 102 is inclined, in a front-rear direction (direction X-X1 in FIG. 7) of the apparatus, downward toward the front side of the apparatus (direction X). Thus the mounted process cartridges 102 have successively different heights.

Figure 7:
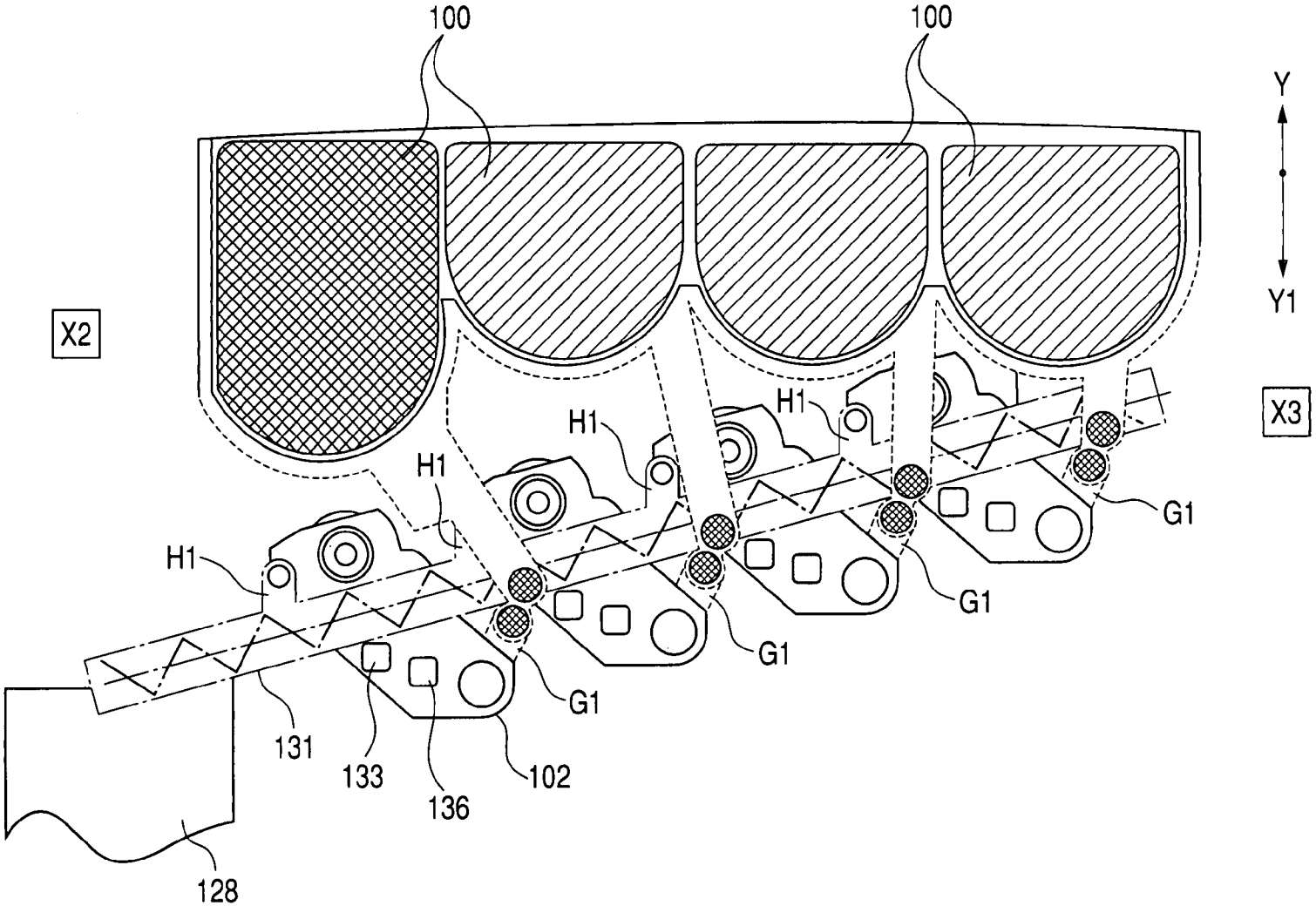
FIG. 7 is a schematic view of the main body from a lateral direction of the apparatus (seen from a direction Z1 in FIG. 5)

It is therefore possible to increase the toner capacity in a frontmost toner cartridge 100 (indicated by crossing lines in FIG. 7). Such a toner cartridge 100 set in the frontmost position and having the larger toner capacity is used for the black color which has a higher frequency of print output, thereby reducing the frequency of replacement of the toner cartridge by the user and reducing the running cost of the toner cartridge.

<Drive Input to Process Cartridge>

Figure 8A:
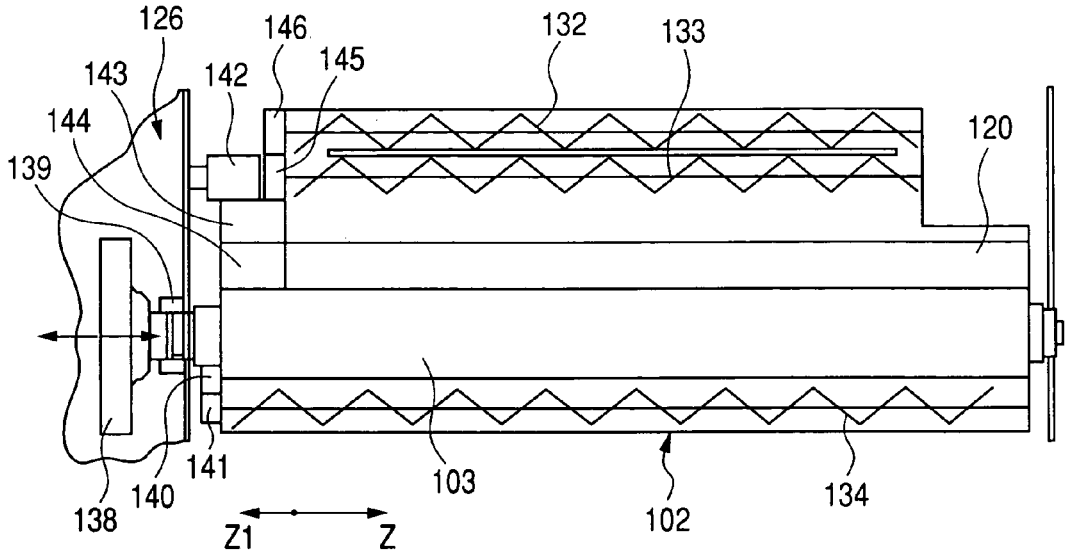
FIGS. 8A, 8B and 8C are schematic views showing a driving power transmission in main body to the process cartridge.
Figure 8B:
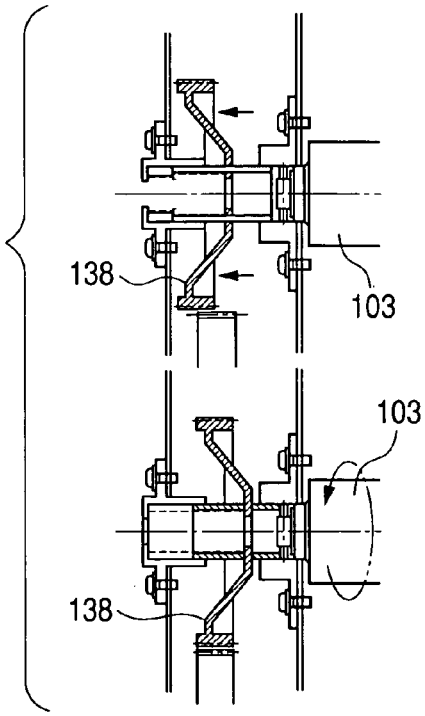
Figure 8C:
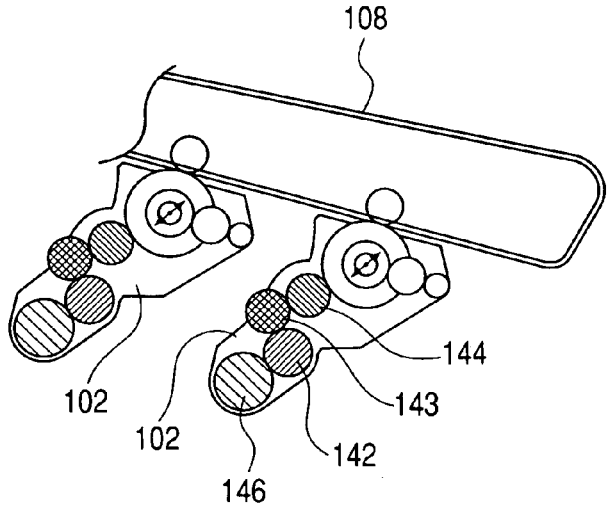

Now a drive input method to the process cartridge 102 will be explained with reference to FIGS. 8A to 8C, in which FIG. 8A is a schematic cross-sectional view of the main body seen from above, FIG. 8B is a schematic cross-sectional view showing a movable configuration of a drum gear, and FIG. 8C is a schematic lateral view around the process cartridge.

As shown in FIGS. 8A and 8B, a drum gear 139 in the driving apparatus 126 for transmitting driving power to the photosensitive drum 103 is rendered movable in a direction Z-Z1, and is shifted to a side Z1 at the replacement of the process cartridge and to a side Z in the operation state of the main body. Such movement in the direction Z-Z1 is achieved in linkage with an opening/closing operation of an unillustrated cartridge replacing cover.

The transmitted driving power is transmitted in succession to a first drum gear 139, a second drum gear 140 and a third drum gear 141 thereby driving the used toner carrying means 134.

Also the developing driving power is transmitted from a developing gear 142 of the driving apparatus 126 to a first developing gear 143 and a second developing gear 144 to drive the developing sleeve 120. The driving power is also transmitted from the first developing gear 143 to agitating gears 145, 146 thereby rotating the first agitating screw 132 and the second agitating screw 133.

<Cartridge Replacement>

Figure 9B:
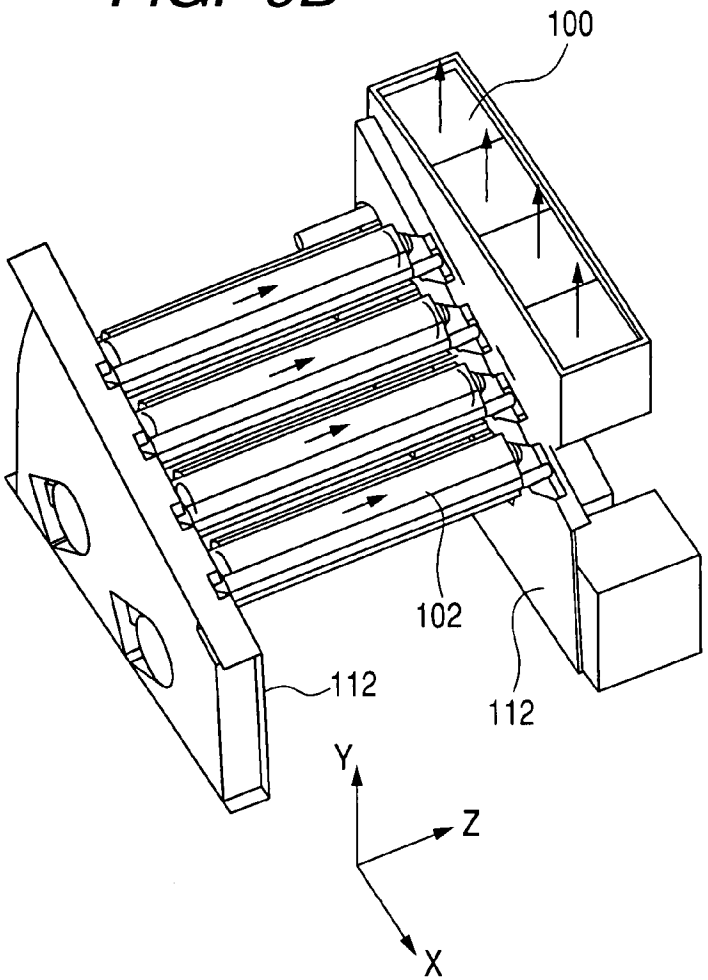
FIGS. 9A and 9B are schematic views showing operations for replacing process cartridges and toner cartridges.
Figure 9A:
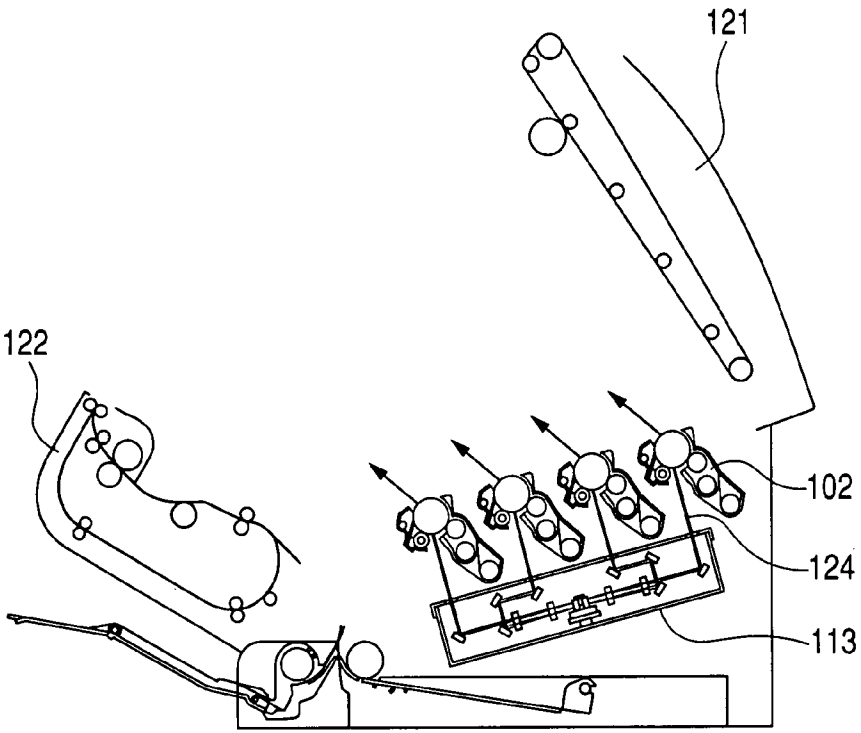

In the following, there will be explained a replacing method for the process cartridge 102 and the toner cartridge 100 with reference to FIGS. 9A and 9B. As shown in FIGS. 9A and 9B, the toner cartridge 100 is provided, with respect to the process cartridge 102, in a higher position in the vertical direction (direction Y) and in a separated position in the lateral direction (direction Z). As the process cartridge 102 and the toner cartridge 100 are movable in the direction Z (the direction along the rotary axis of the photosensitive drum, that is, a direction perpendicular to the generatrix of the surface of the photosensitive drum), in case of dismounting the process cartridge 102 from or mounting it on the main body of the apparatus, the process cartridge 102 can be replaced as shown in FIGS. 9A and 9B without detaching the toner cartridge 100 after the cartridge replacing covers 121, 122 are opened.

It is therefore unnecessary, at the replacement of the process cartridge, to at first remove the toner cartridge and then to replace the process cartridge as in the prior technology, and a direct replacement of the process cartridge is rendered possible to achieve a significant improvement in the convenience of the replacement.

Also at the replacement of the toner cartridge 100, since the toner cartridge 100 is separated from the process cartridge 102 in the direction of the rotary axis of the photosensitive drum (cf. FIGS. 3, 4A and 4B) and is positioned outside (in direction Z) the main body frame member 112, toner 123 eventually dropping from the detached toner cartridge 100 (cf. FIG. 3) does not drop onto the exposure apparatus 113 in the main body frame member 112. It is thus made possible to prevent a toner scattering into the apparatus and a blocking of an optical path 124 by the toner dropping onto the exposure apparatus 113 at the replacement of the toner cartridge 100, thereby ensuring an image output. Also it is rendered possible to position the exposure apparatus 113 in a lower part of the main body frame member 112, thereby increasing design freedom.

Figure 10:
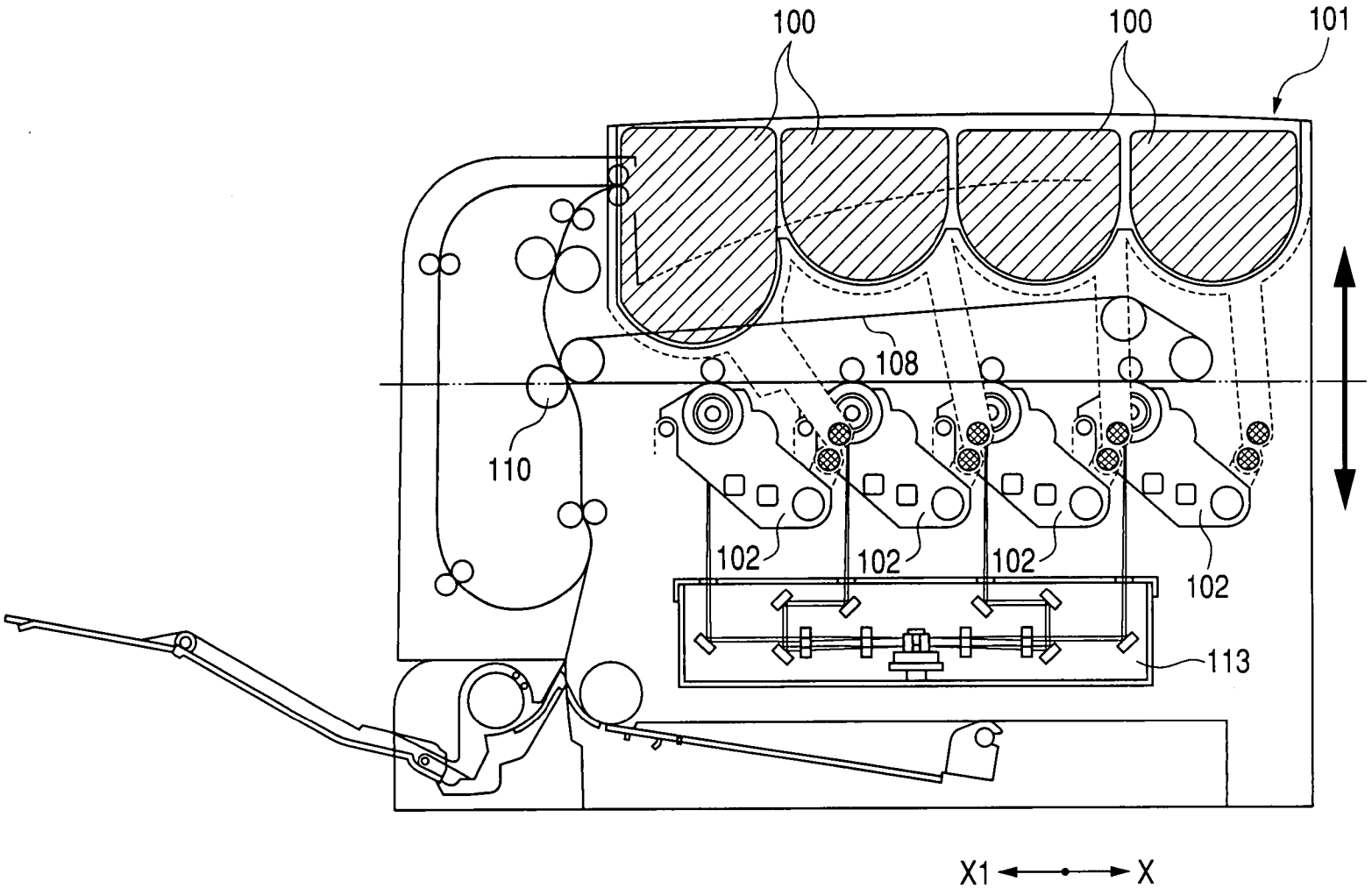
FIG. 10 is a lateral cross-sectional view of an image forming apparatus in which process cartridges are positioned horizontally.

In the aforementioned embodiment, the four process cartridges 102 are positioned successively lower toward the front side of the apparatus, but, even in case the four process cartridges 100 are positioned at a substantially the same height as shown in FIG. 10, it is possible to improve the operability and to prevent trouble by toner dropping at the replacement of the process cartridge, by positioning the toner cartridges 100 and the process cartridges 102 as described above.

The aforementioned effects can be obtained not only in an apparatus utilizing the process cartridge 102 and the toner cartridge 100 in plural units as described above but also in an apparatus utilizing the process cartridge 102 and the toner cartridge 100 in one unit each for forming a monochromatic image, by positioning the process cartridge 102 and the toner cartridge 100 in such a manner that they do not overlap in the direction of the rotary axis of the photosensitive drum 103.

<Positioning of Electric Board>

Figure 11A:
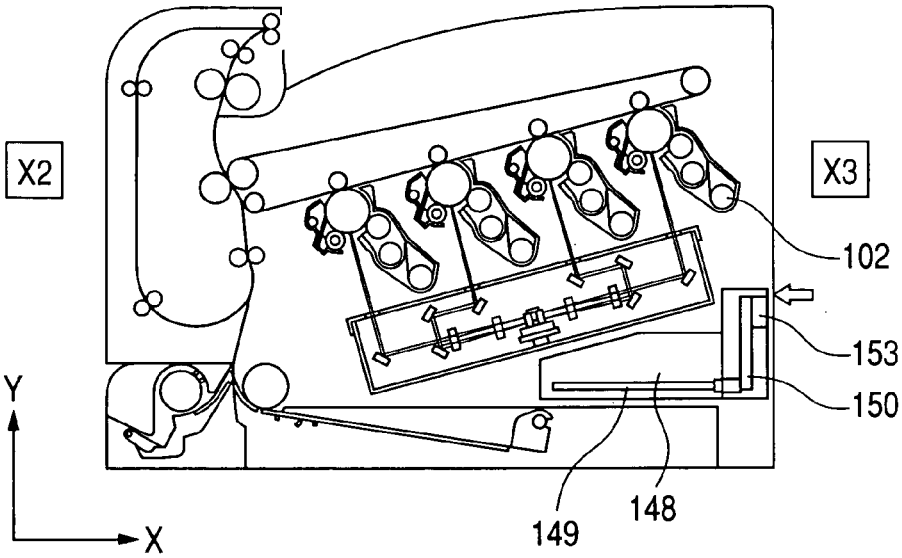
FIGS. 11A and 11B are schematic views showing an electric wiring in an image forming apparatus.

In the following there will be explained an electric configuration of the image forming apparatus with reference to FIGS. 11A and 11B, which are respectively a cross-sectional view and a rear perspective view of the main body.

In the main body frame member 112, the high voltage source apparatus 127 is positioned at a side opposed to the driving apparatus 126, for direct input of the charging bias and the developing bias to the process cartridge 102.

Figure 11B:
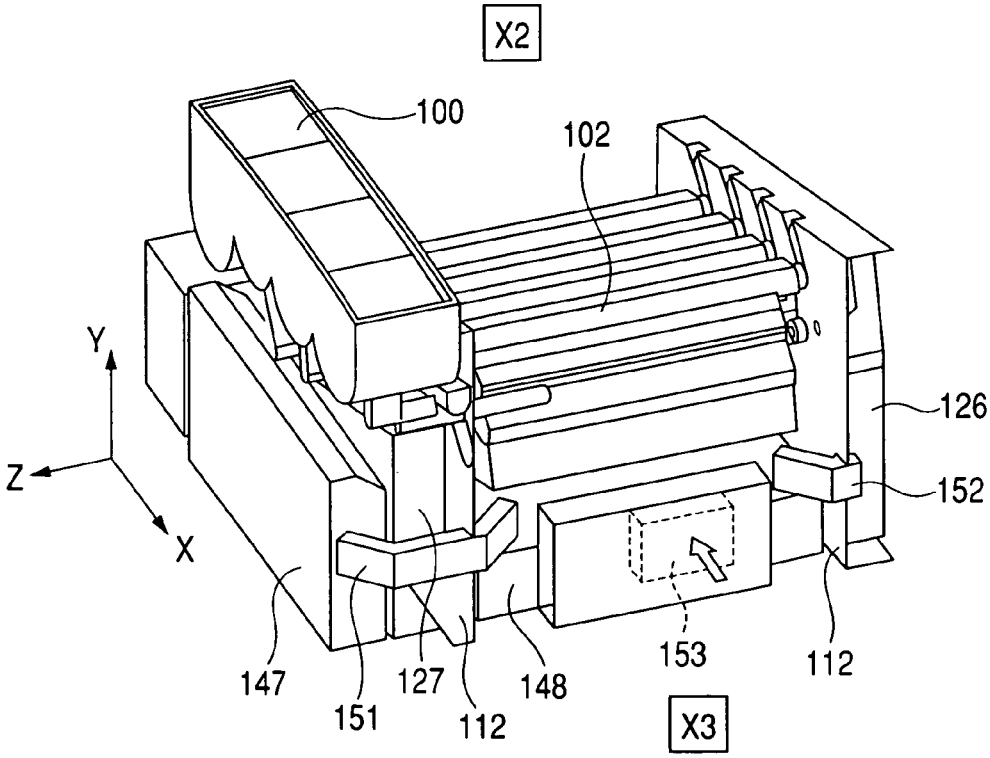
Figure 12A:
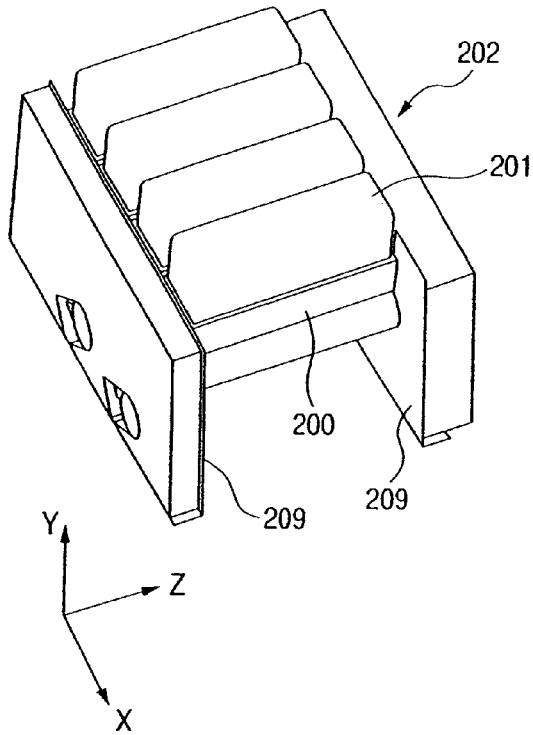
PRIOR ART FIG. 12A
FIGS. 12A and 12B are schematic views showing a prior technology.
Figure 12B:
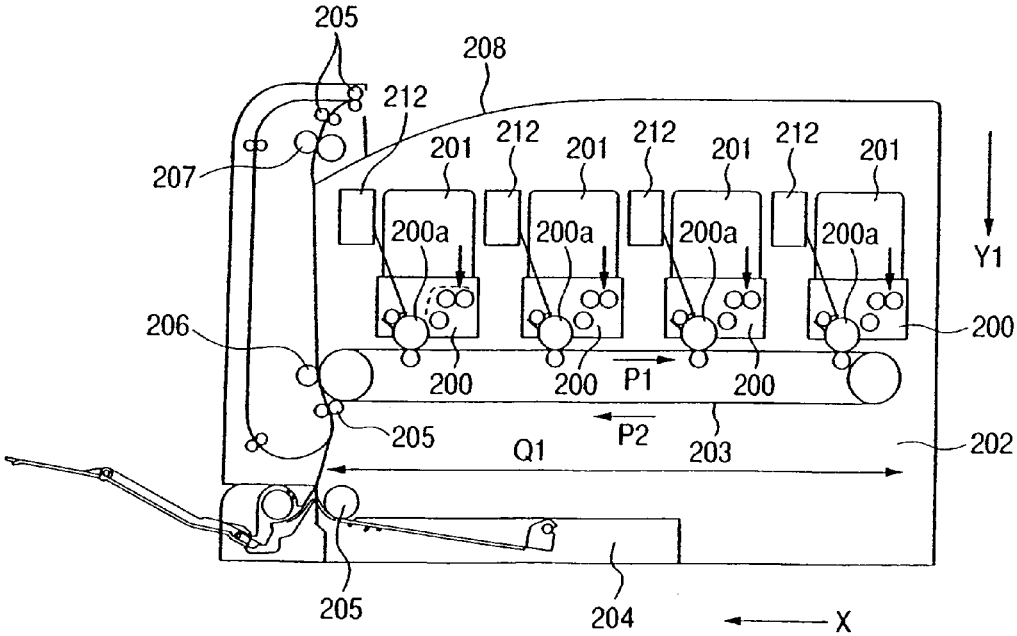
PRIOR ART FIG. 12B
Figure 13:
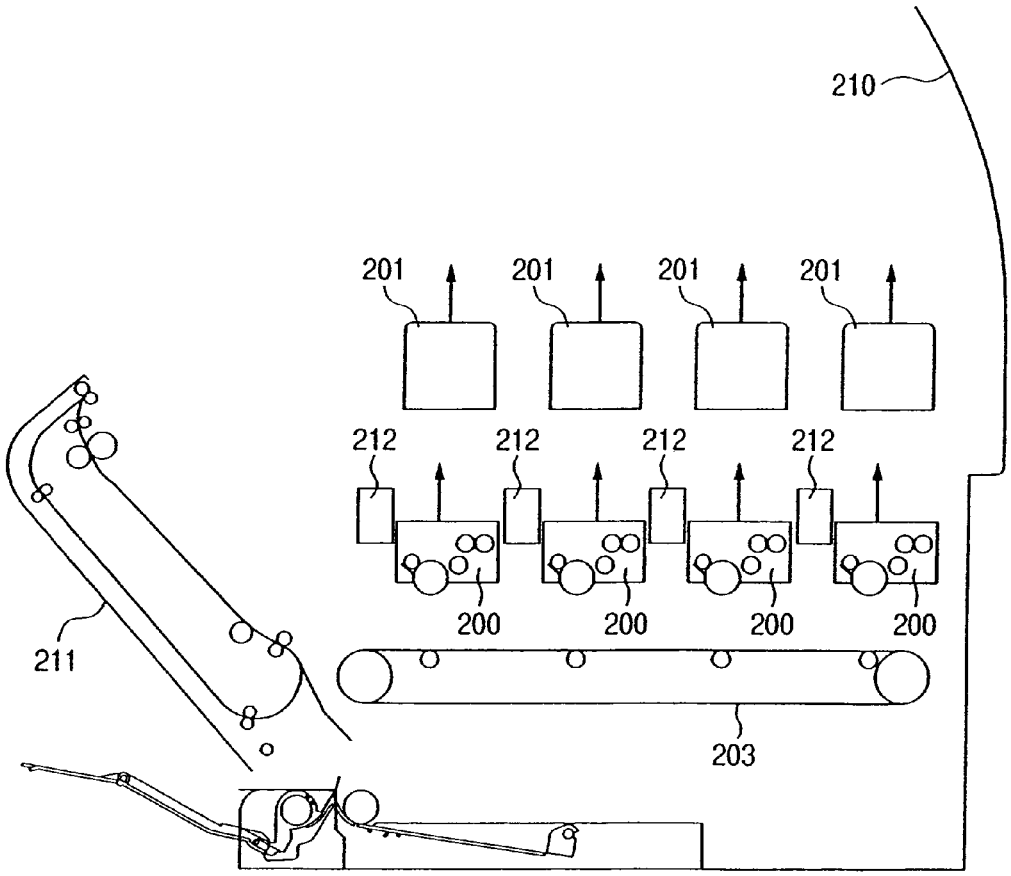
PRIOR ART FIG. 13
FIG. 13 is a schematic view showing a prior technology.
Figure 14A:
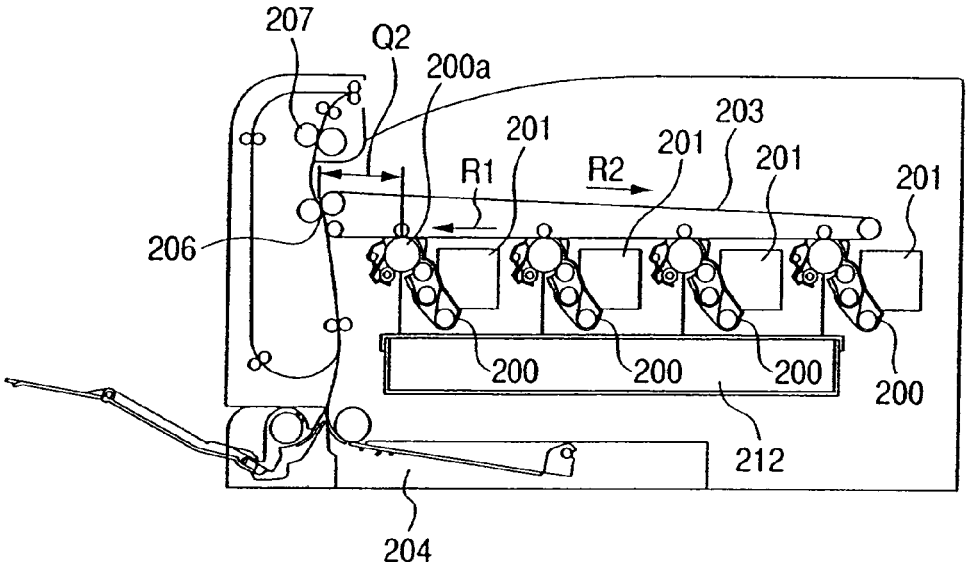
PRIOR ART FIG. 14A
FIGS. 14A and 14B are schematic views showing a prior technology.
Figure 14B:
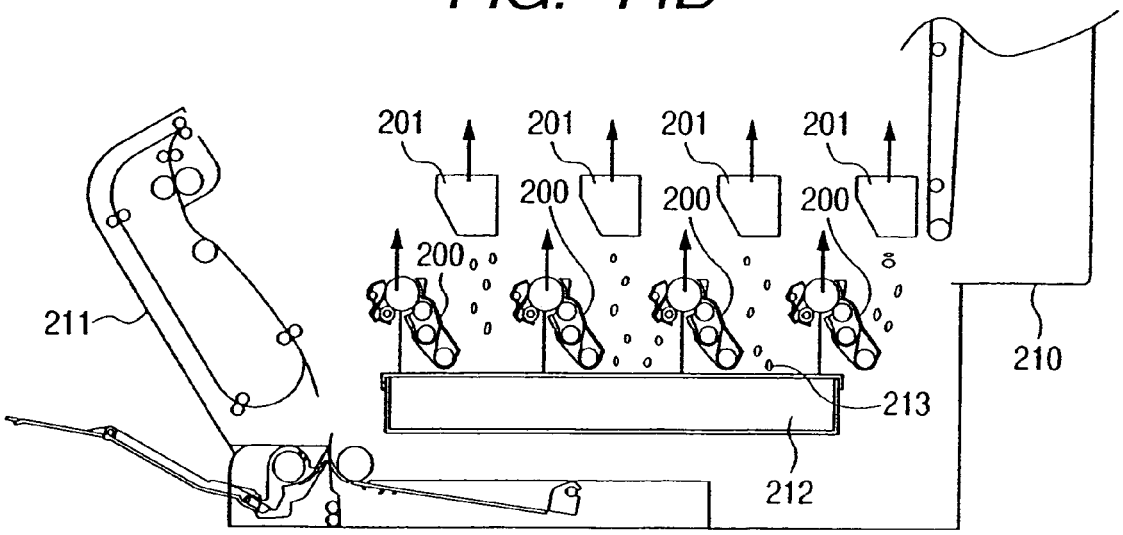
PRIOR ART FIG. 14B

A main power source apparatus 147 of 5-24 V is provided outside the main body of the high voltage power source apparatus 147 (cf. FIG. 11B). Also, a DC control apparatus 148 for on/off control of driving motors is provided in a space within the main body frame member 112, formed by the inclined positioning of the process cartridges 102 (cf. FIG. 11A).

Also, a main body controller apparatus 150 is connected at the outside of the main body of the high voltage source apparatus 127 and at the rear side of the main body of the DC control apparatus 148 (side X3 in FIGS. 11A and 11B), so as to be perpendicular to the board 149 of the DC control apparatus 148. The main body controller apparatus 150, the main power source apparatus 147 and the high voltage power source 127 are connected by a first cable 151 to the DC control apparatus 148. Also, the DC control apparatus 148 is connected by a second cable 152 to motors, clutches, sensors and the like in the driving apparatus 126. Such first cable 151 and second cable 152 are also positioned at the rear side of the main body.

In such arrangement of the power supplies, the DC control apparatus 148 and the main body controller apparatus 150 for controlling the driving apparatus 126, the main power supply apparatus 147 and the high voltage source 127 can be connected evenly to the loads on both sides of the main body frame member 112 and can be positioned in the space of the main body frame member 112 to reduce the dimension of the main body. Also the main body controller apparatus 150 is positioned at the rear side of the main body (side X3 in FIGS. 11A and 11B) to achieve an easy optional connectability of a hard disk apparatus 153, which is optionally connected in the controller apparatus 150 for increasing the data storage capacity and process speed of the print signal and the like.

The foregoing embodiment shows a case where the process cartridge includes the photosensitive drum 103, the primary charger 104, the developing means 105, the drum cleaner apparatus 107 for removing the toner remaining on the photosensitive drum and the used toner carrying means 134 for carrying the used toner removed by the drum cleaner apparatus 107, but the process cartridge may contain at least the photosensitive drum 103 and the developing means 105. Therefore, the process cartridge can be realized in other embodiments, such as an embodiment integrating a photosensitive drum, developing means and a drum cleaner apparatus, an embodiment integrating a photosensitive drum, developing means and primary charging means, and an embodiment integrating a photosensitive drum and developing means.

This application claims priority from Japanese Patent Application No. 2004-178621 filed on Jun. 16, 2004, which is hereby incorporated by reference herein.

What is claimed is:

1. An image forming apparatus comprising:

an image bearing member on which an electrostatic image is formed;

a developing device which develops the electrostatic image with toner, to form a toner image;

toner replenishing device which replenishes a replenishing toner to said developing device;

toner container which contains the replenishing toner, said toner container being dismountably mountable onto a first attachment portion provided outside a frame member of a main body of said image forming apparatus;

a transfer device which transfers the toner image formed on said image bearing member onto a transfer medium;

a cleaning device which collects transfer residual toner on said image bearing member;

a transfer residual toner conveyance device which conveys the transfer residual toner collected into said cleaning device;

a transfer residual toner container which contains the transfer residual toner conveyed by said transfer residual toner conveyance device, the transfer residual toner container being dismountably attachable with respect to a second attachment portion provided at a same side of said image forming apparatus at which the first attachment portion is provided and outside the frame member; and a drive device which provides a drive force to a cartridge, said drive device being provided outside the frame member and at an opposite side at which the first attachment portion and the second attachment portion are provided, wherein at least said image bearing member, said developing device and said cleaning device are provided in the cartridge which is dismountably mountable onto a third attachment portion provided inside the frame member of the main body of said image forming apparatus.

2. An image forming apparatus according to claim 1, wherein an air blower which forms an air flow in a direction from said drive device toward said toner replenishing device.

3. An image forming apparatus according to claim 1, further comprising:

a power source which applies a bias to said developing device, said power source being provided outside a side of said image forming apparatus at which the first attachment portion of the frame member is provided.

4. An image forming apparatus according to claim 1, wherein the transfer medium is an intermediate transferring member, and the toner image on the intermediate transferring member is transferred onto a sheet, and wherein said intermediate transferring member is positioned in an upper side of the image bearing member in a gravitational direction.

5. An image forming apparatus according to claim 1, further comprising:

an exposure device which exposes said image bearing member to form the electrostatic image, said exposure device being provided at a position inside the frame member of said main body of said image forming apparatus and lower than said image bearing member in a gravitational direction.

6. An image forming apparatus according to claim 4, further comprising other cartridges:

wherein the cartridge and the other cartridges are provided in a direction in which said intermediate transferring member moves so that the farther a cartridge among the cartridge and the other cartridges is provided from the most upstream cartridge, the lower the cartridge is provided in a gravitational direction, and wherein a toner conveyance path in said transfer residual toner conveyance device is provided along sides of the cartridge and the other cartridges so that the farther a position is in the toner conveyance path from the most upstream cartridge in the direction in which said intermediate transferring member moves, the lower the position in the toner conveyance path.

* * * * *

UNITED STATES PATENT AND TRADEMARK OFFICE

CERTIFICATE OF CORRECTION

PATENT NO. : 7,257,349 B2
APPLICATION NO. : 11/141012
DATED : August 14, 2007
INVENTOR(S) : Yukihiro Kitozaki It is certified that error appears in the above-identified patent and that said Letters Patent is hereby corrected as shown below:

COLUMN 1
Line 39, “respectively” should read --respective--.

COLUMN 4
Line 7, “hotosensitive” should read --photosensitive--.

COLUMN 6
Line 5, “sed” should read --used--.

COLUMN 7
Line 34, “As” should begin a new paragraph.

COLUMN 10
Line 32, “cartridges:” should read --cartridges,--.

Signed and Sealed this

Third Day of February, 2009

JOHN DOLL
*Acting Director of the United States Patent and Trademark Office*